US011946215B2

(12) United States Patent
Creech, Jr. et al.

(10) Patent No.: US 11,946,215 B2
(45) Date of Patent: Apr. 2, 2024

(54) SHORELINE STABILIZATION DEVICE

(71) Applicant: THE DAVEY TREE EXPERT COMPANY, Kent, OH (US)

(72) Inventors: Frederick Worth Creech, Jr., Raleigh, NC (US); Mary-Margaret Sykes McKinney, Edenton, NC (US)

(73) Assignee: The Davey Tree Expert Company, Kent, OH (US)

( * ) Notice: Subject to any disclaimer, the term of this patent is extended or adjusted under 35 U.S.C. 154(b) by 0 days.

(21) Appl. No.: 17/702,017

(22) Filed: Mar. 23, 2022

(65) Prior Publication Data

US 2023/0304244 A1 Sep. 28, 2023

(51) Int. Cl.
*E02B 3/04* (2006.01)
*E02B 3/06* (2006.01)

(52) U.S. Cl.
CPC ..... *E02B 3/06* (2013.01)

(58) Field of Classification Search
CPC ... E02B 3/06; E02B 3/04; E02B 3/046; E02B 3/14; E04H 17/1413; E04H 17/1404; E04H 17/1408; E01F 7/02
USPC ..... 405/15, 29, 33, 34, 35
See application file for complete search history.

(56) References Cited

U.S. PATENT DOCUMENTS 5,599,136 A * 2/1997 Wilke ..... E02B 3/12 405/15
10,053,827 B2 8/2018 Martin et al.
2016/0067883 A1* 3/2016 Hilton ..... B28B 7/18 264/300

* cited by examiner

*Primary Examiner* — Sean D Andrish
(74) *Attorney, Agent, or Firm* — TUCKER ELLIS LLP

(57) ABSTRACT

A system is provided for shoreline stabilization having at least five rectangular shoreline stabilization devices; wherein a first two of the devices are arranged on opposite sides of a line running perpendicular to the first two devices; at least one of the devices is positioned perpendicular to and on top or in between the first two devices, and atop the line; and wherein a second two of the devices are each positioned at an angle relative to the first two devices to provide two angled devices, with a first end on top of one of the first two devices and a second end resting on at least one of the perpendicular devices to form an angle between a slope of between about 1.5:1 and 2:1, wherein the two angled devices are not resting on the same one of the first two devices.

4 Claims, 3 Drawing Sheets

SHORELINE STABILIZATION DEVICE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an arrangement of a shoreline stabilization device when the device is deployed.

Description of Related Art

The erosion of coastal shorelines (and other similar shorelines) by both natural and man-made activities has become a very serious and urgent matter having detrimental effects in some areas of the world. There has been much work in developing shoreline stabilization devices, especially ones capable of supporting aquatic life. Both attenuation of erosion by waves, as well as a need to reinforce the shoreline, are the primary uses of such devices.

While there are many examples of such shoreline devices, there are serious and inadequate problems with the currently used devices. These problems include use of plastics, introduction of loose fibers to the shoreline, a lack of means to prevent wave erosion, the need to regrade the shoreline, the need to position plants in the device, and devices that are primarily made of cement. In addition, shoreline stabilization may need to be customized to the type of shoreline and to the extent of erosion. What is needed is a system of arranging shoreline devices that best supports living growth, shoreline fortification, and wave erosion reduction without the drawback of the current ways of arranging the shoreline device(s).

BRIEF SUMMARY OF THE INVENTION

It has been discovered that a particular positioning of shoreline stabilization devices improves aquatic habitat function, oyster recruitment, and wave attenuation when compared to other positional arrangements.

Accordingly, the present invention relates to a system for shoreline stabilization comprising:

a) at least five rectangular shoreline stabilization devices;

b) wherein a first two of the shoreline stabilization devices are arranged linearly;

c) wherein at least one of the shoreline stabilization devices is positioned perpendicular to and on top or in between the two linear shoreline stabilization devices; and d) wherein a second two of the shoreline stabilization devices are each positioned at an angle relative to the linear shoreline stabilization devices with a first end on top of one of the linear stabilization devices and a second end resting on at least one of the perpendicular shoreline stabilization devices to form an angle between a slope of between about 1.5:1 and 2:1, wherein the two angled shoreline stabilization devices are not resting on the same linear stabilization device.

DETAILED DESCRIPTION OF THE INVENTION

Figure 1A:
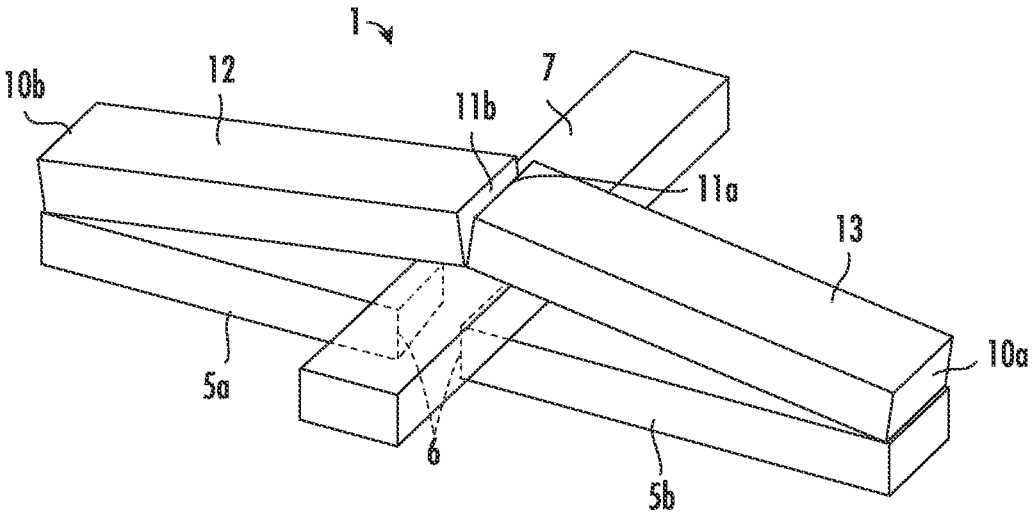
FIG. 1*a* is a perspective view of a system of the present invention with five shoreline stabilization devices.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "shoreline stabilization device" refers to one or more blocks (rectangular) that are positioned in the water near the shoreline. The blocks can be positioned independent of other blocks or tied together connecting all the blocks into a group of blocks. They are arranged in the present system as shown in the figures and in the claims. In the figures, there are at least five blocks, which are arranged wherein a first two of the shoreline stabilization devices are arranged linearly; wherein at least one of the shoreline stabilization devices is positioned perpendicular to and on top or in between the two linear shoreline stabilization devices; and wherein a second two of the shoreline stabilization devices are each positioned with a first end on top of one of the linear stabilization devices and a second end resting on at least one of the perpendicular shoreline stabilization devices to form an angle between a slope of between about 1.5:1 and 2:1, wherein the two angled shoreline stabilization devices are not resting on the same linear stabilization device.

The device can also, in one embodiment, have reinforcing rods like rebar to stabilize the block, especially for blocks that are larger. The limiting factor of the size of the blocks is the weight and how well it conforms to the shoreline in shape.

As used herein, the term "primarily calcium carbonate material" refers to once living material from a living organism that produces portions of the organism that are primarily made up of calcium carbonate. Included are aquatic shells, like oysters, egg shells, snail shells, pearls, and the like. A collection of these materials is treated with cement in a block form to produce a block of the material, once the cement dries.

As used herein, the term "cement" refers to any biocompatible material, which can be used to hold the primarily calcium carbonate material together in a block form and be resistant to wave action, storms, and the like. An example includes, but is not limited to, portland cement. In one embodiment, the cement is a bio-cement compatible with the primarily calcium carbonate material, which has the capability of supporting growth on the block formation by the primarily calcium carbonate material and cement.

An example includes quicklime made from oyster shells.

As used herein, the term "arranged linearly" refers to the bottom two shoreline stabilization devices being arranged in a line, end to end, as shown in the figures. In one embodiment, there is a space between the bottom two shoreline stabilization devices and in another embodiment, they are touching.

As used herein, the term "perpendicular to" refers to one or more shoreline stabilization devices being placed perpendicular on or in between the bottom two shoreline stabilization devices.

As used herein, the term "on top" refers to on top of one or both of the linear shoreline stabilization devices.

As used herein, the term "in between" refers to being positioned in between the linear shoreline stabilization devices.

As used herein, the term "positioned at an angle" refers to a shoreline stabilization device which has a first end on top of one of the linear shoreline stabilization devices and the second end rests on one of the perpendicular shoreline stabilization devices. This creates an angle that is not parallel to the linear shoreline stabilization devices. In general, this forms an angle in relationship to the linear shoreline stabilization devices of a slope of between about 1.5:1 and 2:1, wherein there are two angled shoreline stabilization devices and each is not resting on the same linear stabilization device

DRAWINGS

Figure 1B:
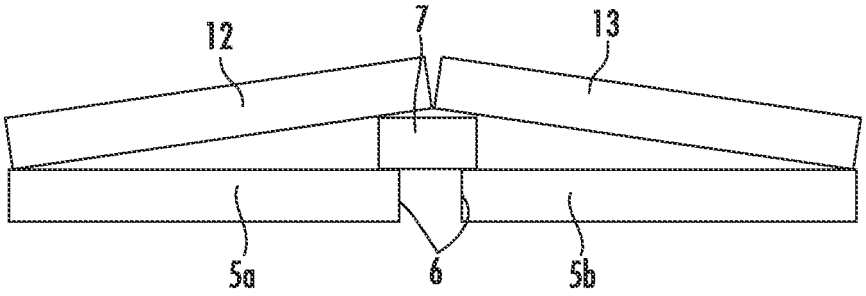
FIG. 1*b* is a side view of the shoreline stabilization devices of FIG. 1*a* of the present invention.

Now referring to the drawings, FIG. 1*a* is a perspective view of an embodiment of the shoreline stabilization device system 1, having five shoreline stabilization devices (5*a*, 5*b*, 7, 12, and 13). In this view, two shoreline stabilization devices 5*a* and 5*b* are arranged linearly with a gap 6 between shoreline stabilization devices 5*a* and 5*b*. A third shoreline stabilization device 7 is positioned perpendicular to the two linear shoreline stabilization devices 5*a* and 5*b* and covering gap 6. There are two more shoreline stabilization devices that are angled compared to the two linear shoreline stabilization devices 5*a* and 5*b*. A first end 10*a* and 10*b* of each angled shoreline stabilization devices 12 and 13 rests on top of one of the two linear shoreline stabilization devices with the second end 11*a* and 11*b* resting on the perpendicular shoreline stabilization device with a slope of between about 1.5:1 and 2:1. FIG. 1*b* depicts a side view of the system of FIG. 1*a*.

Figure 2A:
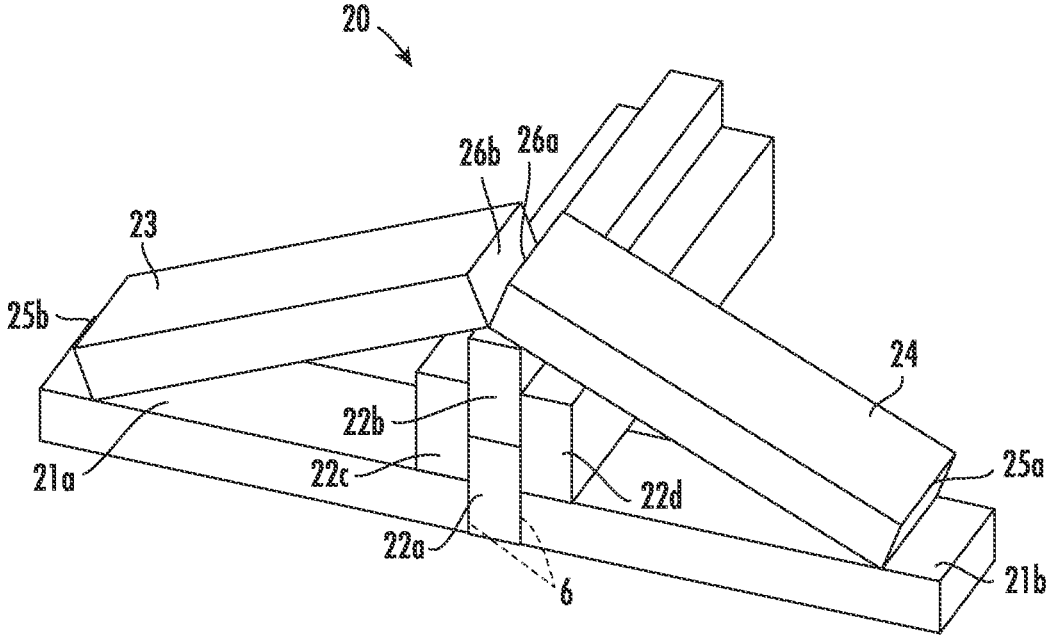
FIG. 2*a* is a perspective view of a system of the present invention with eight shoreline stabilization devices, with one of the shoreline stabilization devices positioned between two other shoreline stabilization devices.
Figure 2B:
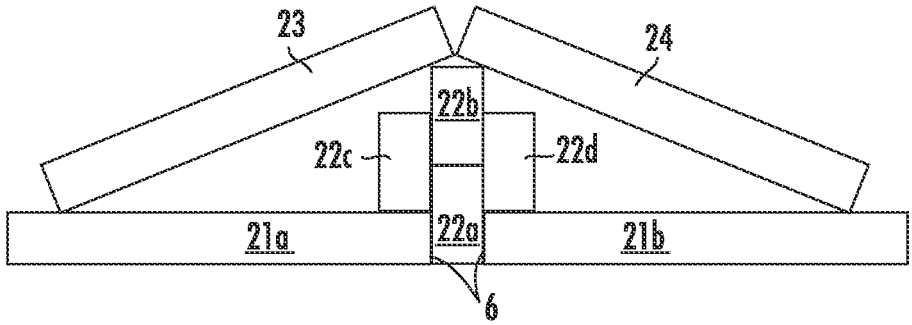
FIG. 2*b* is a side view of the shoreline stabilization devices of FIG. 2*a* of the present invention.

FIG. 2*a* shows a perspective view of a different embodiment 20 of the shoreline stabilization device system. In this view, there are eight shoreline stabilizations devices (21*a*, 21*b*, 22*a*, 22*b*, 22*c*, 22*d*, 23, and 24) utilized. Similar to FIG. 1*a*, there are two shoreline stabilization devices 21*a* and 21*b* that are arranged linearly with a gap 6 between shoreline stabilization devices 21*a* and 21*b*. A third, fourth, fifth, and sixth shoreline stabilization devices 22*a*, 22*b*, 22*c*, and 22*d* are positioned perpendicular to the two linear shoreline stabilization devices with one 22*a* filling the gap 6 between the linear shoreline stabilization devices 21*a* and 21*b*. There are two more shoreline stabilization devices 23 and 24 that are angled compared to the two linear shoreline stabilization devices 21*a* and 21*b*. A first end 25*a* and 25*b* of each angled shoreline stabilization devices 23 and 24 rests on top of one of the two linear shoreline stabilization devices with the second end 26*a* and 26*b* resting on one of the perpendicular shoreline stabilization devices 22*b* with a slope of between about 1.5:1 and 2:1. FIG. 2*b* depicts a side view of the system of FIG. 2*a*.

Figure 3A:
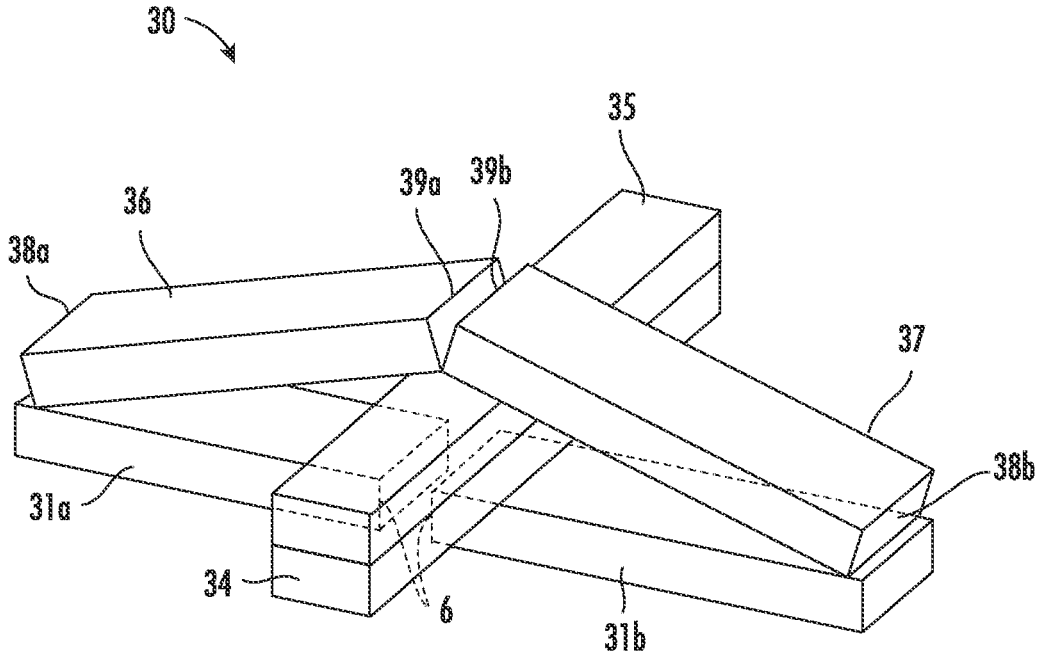
FIG. 3*a* is a perspective view of a system of the present invention with six shoreline stabilization devices.
Figure 3B:
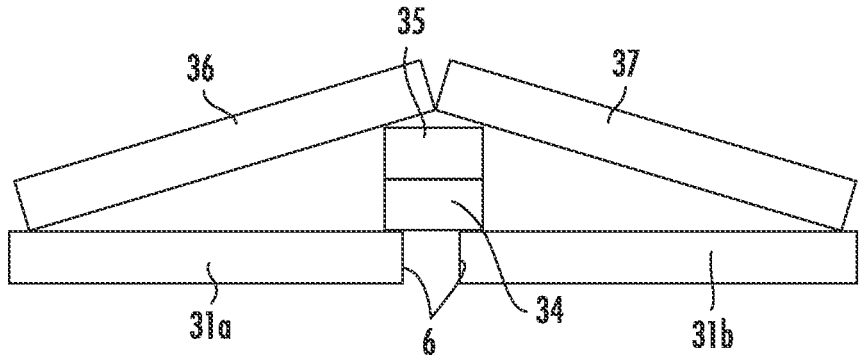
FIG. 3*b* is a side view of the shoreline stabilization devices of FIG. 3*a* of the present invention.

FIG. 3*a* shows a perspective view of a different embodiment 30 of the shoreline stabilization device system. In this view, there are six shoreline stabilization devices utilized (31*a*, 31*b*, 34, 35, 36, and 37). Similar to FIG. 1*a* there are two shoreline stabilization devices 31*a* and 31*b* that are arranged linearly with a gap 6 (shown in FIG. 3*b*) between shoreline stabilization devices 31*a* and 31*b*. A third and fourth shoreline stabilization device 34 and 35 are positioned perpendicular to the two linear shoreline stabilization devices 31*a* and 31*b* with one shoreline stabilization device 34 covering gap 6, and the second shoreline stabilization device 35 resting on top of shoreline stabilization device 34. There are two more shoreline stabilization devices 36 and 37 that are angled compared to the two linear shoreline stabilization devices 31*a* and 31*b*. A first end 38*a* and 38*b* of each angled shoreline stabilization devices 36 and 37 rests on top of one of the two linear shoreline stabilization devices 31*a* and 31*b* with the second end 39*a* and 39*b* resting on one of the perpendicular shoreline stabilization devices 35 with a slope of between about 1.5:1 and 2:1. FIG. 3*b* depicts a side view of the system in FIG. 3*a*.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A system for shoreline stabilization comprising:

a) at least five rectangular shoreline stabilization devices;

b) wherein a first two of the shoreline stabilization devices are arranged end-to-end;

c) wherein at least one of the shoreline stabilization devices is positioned perpendicular to and on top of or in between adjacent ends of the first two end-to-end shoreline stabilization devices; and d) wherein a second two of the shoreline stabilization devices are each positioned at an angle relative to the first two end-to-end shoreline stabilization devices to provide two angled shoreline stabilization devices, with a first end on top of one of the first two end-to-end shoreline stabilization devices and a second end resting on at least one of the perpendicular shoreline stabilization devices to form an angle between a slope of between about 1.5:1 and 2:1, wherein the two angled shoreline stabilization devices are not resting on the same one of the first two end-to-end shoreline stabilization devices.

2. The system for shoreline stabilization according to claim 1, wherein each of the at least five shoreline stabilization devices comprises:

a) a plurality of primarily calcium carbonate material obtained from living sources;

b) a cement that is capable of holding the plurality of primarily calcium carbonate material in a block; and c) wherein the plurality of primarily calcium carbonate material is held together in a block form by the cement.

3. The system for shoreline stabilization according to claim 2, wherein the plurality of primarily calcium carbonate material is aquatic shells.

4. The system for shoreline stabilization according to claim 2, wherein the cement is a bio-cement.

* * * * *